US006116489A

United States Patent [19]

Branston

[11] Patent Number: 6,116,489

[45] Date of Patent: Sep. 12, 2000

[54] MANUALLY OPERABLE INTERNAL COMBUSTION-TYPE IMPACT TOOL WITH REDUCED RECYCLER STROKE

[75] Inventor: Paul Gordon Branston, Vancouver, Canada

[73] Assignee: Pow-R-Tools Corporation, Vancouver, Canada

[21] Appl. No.: 09/179,846

[22] Filed: Oct. 28, 1998

[51] Int. Cl.[7] ..... B25C 1/04

[52] U.S. Cl. ..... 227/10; 227/130; 123/46 SC; 60/632

[58] Field of Search ..... 227/8, 10, 9, 130; 123/46 SC; 60/632, 633

[56] References Cited

U.S. PATENT DOCUMENTS

| | | | |
|---|---|---|---|
| 3,042,008 | 7/1962 | Liesse . | |
| 4,200,213 | 4/1980 | Liesse . | |
| 4,483,474 | 11/1984 | Nikolich | 227/10 |
| 4,712,379 | 12/1987 | Adams et al. . | |
| 4,913,331 | 4/1990 | Utsumi et al. | 227/10 |
| 5,090,606 | 2/1992 | Torii et al. | 123/46 SC |
| 5,191,861 | 3/1993 | Kellerman et al. . | |
| 5,213,247 | 5/1993 | Gschwend et al. | 227/10 |
| 5,687,899 | 11/1997 | Dohi et al. | 227/130 |

FOREIGN PATENT DOCUMENTS 0277480 7/1988 European Pat. Off. .

*Primary Examiner*—Scott A. Smith
*Attorney, Agent, or Firm*—Oyen Wiggs Green & Mutala

[57] ABSTRACT

A detonating impact tool, such as a nailer, has a manual recycler. The recycler has a pump housing which is moved through a stroke to purge exhaust combustion gases from the tool. The tool provides pump housing which operates with a significantly reduced stroke as compared to previous manual recyclers. The tool has a return spring which automatically returns the piston and its associated driver to a rest position part way along a cylinder and forward of a vent port after each detonation. In one embodiment of the invention a restriction in the cylinder wall temporarily holds the piston at its rest position. The stroke reduction system reduces the length of travel of the pump section for easier and faster tool performance while the more compact design enhances market appeal. The reduced stroke facilitates embodiments of the invention wherein the pump housing is actuated by a squeeze lever.

26 Claims, 11 Drawing Sheets

MANUALLY OPERABLE INTERNAL COMBUSTION-TYPE IMPACT TOOL WITH REDUCED RECYCLER STROKE

FIELD OF THE INVENTION

This invention relates to combustion type impact tools wherein the combustion of a fuel drives a piston along a cylinder. The piston moves a driver which does work, such as driving a fastener. The invention has specific application to impact tools having manual recyclers.

BACKGROUND

Adams et al., U.S. Pat. No. 4,712,379, for which the applicant is a co-inventor, describes a manual recycler for a combustion operated impact tool. A use can prepare the impact tool to be fired by operating the manual recycler. Operating the recycler compresses a charge of fuel air mixture behind a piston in a cylinder of the impact tool. The Adams et al. recycler includes a pump housing which a user can manually pump rearwardly against the bias of a spring before firing the impact tool. After the impact tool has been fir(ed the user can allow the pump housing to move forwardly. As the pump housing moves rearwardly a fastener engages an impart rod on the piston and carries the piston rearwardly. The piston compresses a fuel/air mixture in the cylinder in preparation for firing the impact tool. After firing, as the pump housing moves forwardly a fresh fuel/air charge is drawn into the detonation chamber and any exhaust gases remaining in the cylinder are purged through exhaust ports. In the Adams et al. impact tool the pump housing is required to move rearwardly and forwardly by about the same distance as the stroke of the piston.

While the manual recycler described by Adams et al. has proven to be practical and useful, the pump housing must be moved undesirably far to recycle the tool. This is a particular disadvantage in applications where the piston must have a longer stroke. For example, in impact nailers designed for nailing with long nails the piston stroke must at least as long as the length of the longest nails being driven. It can be tiring for a user to cycle the pump housing through a distance of several inches before every firing. There is a need for an impact tool which retains the simplicity and ruggedness of a manual recycler but requires less physical effort to use.

The prior art includes various designs for impact tools which recycle automatically. Kellerman et al. U.S. Pat. No. 5,191,861 describes one example of an impact tool having an automatic recycler. The Kellerman et al. tool has a piston which compresses an internal spring when the tool is fired. The spring returns the piston and driver to the top of the piston cylinder after each impact stroke. A disadvantage of the Kellerman et al. tool is that it requires a complicated system for accurately metering and injecting fuel gas into the detonation chamber. This system includes a relatively complicated automatic recycler which recycles the tool in several coordinated stages.

Liesse, U.S. Pat. Nos. 3,042,008 and 4,200,213 disclose nailing devices having combustion chambers defined between two pistons which face each other in the bore of a cylinder. The pistons are each mounted on springs. The provision of two pistons makes the Liesse impact tools; heavier and more complicated than is desirable.

There is an ongoing need for a simple reliable manually recycled detonation driven impact tool which can be operated with less effort than previous impact tools. There is a particular demand for such tools which have simple robust construction so that they may be manufactured in a straight forward manner and at a reasonable cost.

SUMMARY OF THE INVENTION

This invention provides an impact tool having a manually operated recycler which can be operated with a shorter stroke than previous manually cycled impact tools.

One aspect of the invention provides an impact tool comprising: a main housing; a piston disposed within a bore of a cylinder in the main housing, the cylinder having a wall, the piston slidably movable along the cylinder bore between a rearward position and a forward position, the piston having a forwardly extending impact rod; a return spring, the return spring biasing the piston rearwardly in the bore when the piston is in its forward position; a venting port in the cylinder wall, the venting port located forwardly of the piston when the piston is in its rearward position rearwardly of the piston when the piston is in a rest position between the forward and rearward positions; a pump housing slidably and sealingly mounted to the main housing, the pump housing and the main ho)using defining between themselves a pumping volume which communicates with the venting port, the pump housing displaceable rearwardly relative to the main housing between a first position and a second position; and, an exhaust valve venting the pumping volume. When the piston is in its rearward position and a fuel/air mixture behind the piston is detonated, the piston is driven forwardly to its forward position and then the return spring moves the position rearwardly to the rest position where the piston stops. Because the piston stops at a rearwardly located rest position and not at a forward end of the cylinder the stroke needed to recycle the tool is reduced. The impact tool avoids the complexities required to provide automatic recycling.

An impact tool according to some embodiments of the invention is equipped with a squeeze member, such as a handle or a lever, connected to the pump housing by a linkage. An operator can cause the pump housing to move so as to recycle the impact tool by moving the squeeze member. The linkage may include a gear train having a transmission ratio of more than 1:1 so that the pump housing has a larger range of motion than the squeeze member.

Preferred embodiments of the impact tool have an exhaust port forward of the venting port at , forward end of the cylinder. The piston is forward of the exhaust port when the piston is in its forward position. This allows most exhaust gases to escape through the exhaust port.

Another aspect of the invention provides an impact tool comprising: a main housing; a piston disposed within a bore of a cylinder in the main housing, the cylinder having a wall, the piston slidably movable along the cylinder bore between a rearward position and a forward position wherein the piston is forward from an exhaust port at a forward end of the cylinder, the piston having a forwardly extending impact rod; a return spring, the return spring biasing the piston rearwardly in the bore when the piston is in its forward position; a constriction in the cylinder bore between the rearward and forward positions; a venting port in the cylinder wall rearwardly adjacent the constriction; a pump housing slidably and sealingly mounted to the main housing, the pump housing and the main housing defining between themselves a pumping volume which communicates with the venting port, the pump housing displaceable rearwardly relative to the main housing between a first position and a second position; and, an exhaust valve venting the pumping volume. When the piston is in its rearward position and a fuel/air mixture behind the piston is detonated, the piston is driven forwardly to its forward position and then the return spring moves the piston rearwardly until the constriction stops the piston at a rest position forward of the venting port.

The constriction preferably comprises a junction in the cylinder wall between a straight portion and a tapered portion.

A third aspect of the invention provides a detonation impact tool. the tool comprises:

a) a cylinder having a bore and a detonation chamber portion in the bore;

b) an axially movable piston in the cylinder, the piston having a forwardly extending impact rod, the piston movable between a first rearward position and a second forward position;

c) a main housing surrounding a space around the cylinder;

d) a pump housing axially movable in the space between the cylinder and the main housing;

e) bias means biasing the pump housing forwardly in the space;

f) a seal between the main housing and the pump housing;

g) an exhaust passageway leading from a region of the cylinder cleared by a head of the piston at full impact stroke and through the pump housing;

h) a return spring between the piston and a forward end of the cylinder;

i) a brake providing resistance to rearward motion of the piston when the piston is moving in a region between the forward and rearward positions, the brake arresting return spring driven rearward motion of the piston at a rest position between the rearward and forward positions;

j) a vent passageway rearwardly adjacent the piston when the piston is in its rest position;

k) a check-valved inlet to the detonation chamber; and, l) a check valve in the exhaust passageway.

Yet another aspect of the invention provides an impact tool comprising: a main housing; a piston disposed within a bore of a cylinder in the main housing, the cylinder having a wall, the piston slidably movable along the cylinder bore between a rearward position and a forward position, the piston having a forwardly extending impact rod; bias means biasing the piston rearwardly in the bore when the piston is in its forward position; venting means for allowing gases to escape from the cylinder, the venting means located forwardly of the piston when the piston is in its rearward position and rearwardly of th(e piston when the piston is in a rest position between the forward and rearward positions; and, manually operable pumping means connected to the venting means for drawing gases out of the cylinder by way of the venting means. When the piston is in its rearward position and a fuel/air mixture behind the piston is detonated, the piston is driven forwardly to its forward position. The bias means then moves the position rearwardly to the rest position where the piston stops.

BRIEF DESCRIPTION OF THE DRAWINGS

In drawings which illustrate preferred embodiments of the invention, but which should not be construed so as to limit the scope of the invention.

DETAILED DESCRIPTION

Figure 1:
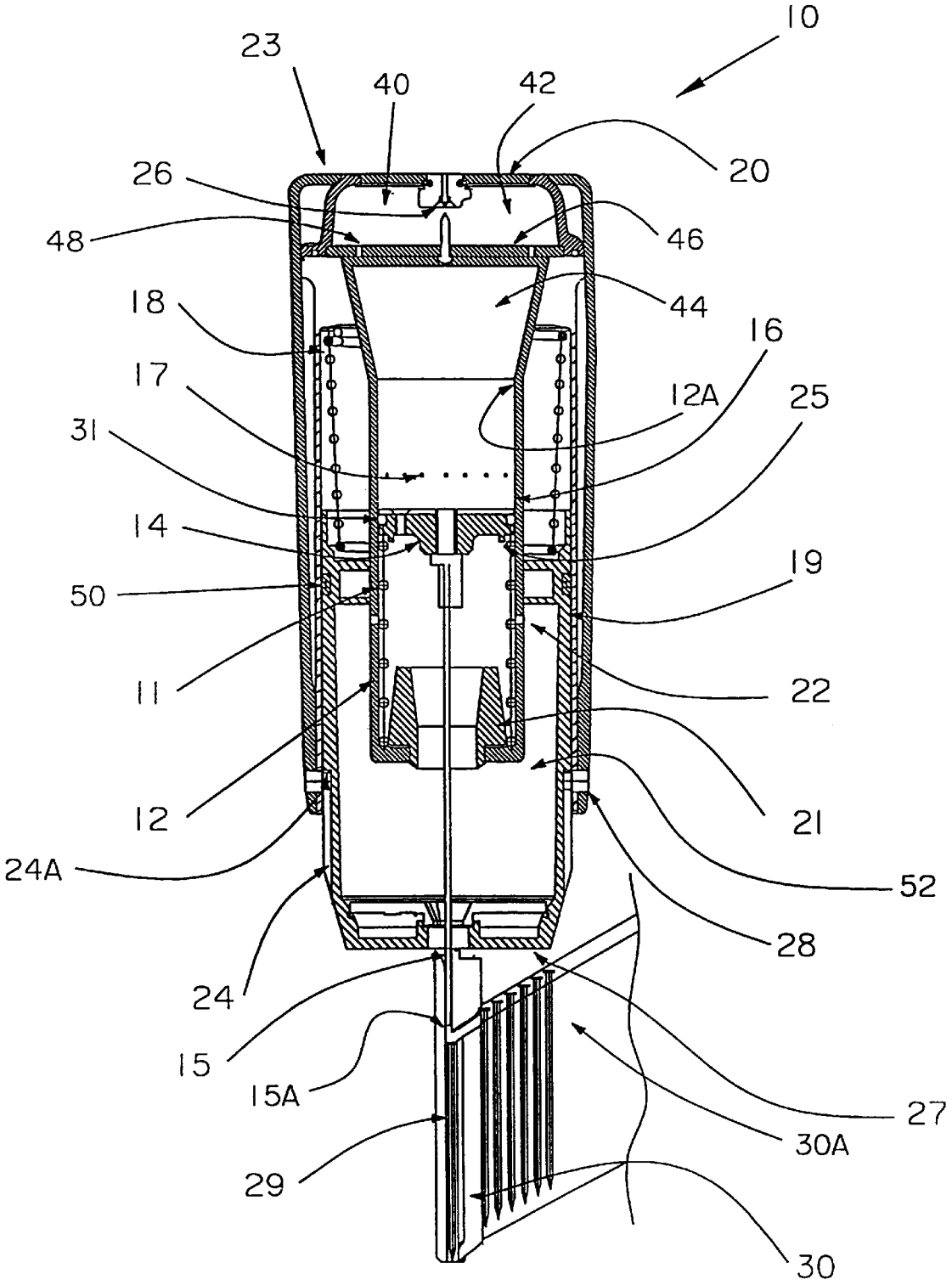
FIG. 1 is a partially schematic sectional view through a nailer incorporating a manual recycler according to this invention.

FIG. 1 is a partial, schematic, sectional view through a combustion driven impact nailer 10 which incorporates a stroke reduction system according to the invention. In the accompanying drawings some conventional parts are not shown so that the stroke reduction system of the invention can be more clearly appreciated. Nailer 10 has a main housing 23 which is typically equipped with a handle (not shown in FIGS. 1–5) and a trigger (not shown in FIGS. 1–5) on the handle. A user can drive a fastener 29 into a surface S (FIG. 2) by bringing barrel 30 into contact with surface S, pushing barrel 30 against surface S to compress a fuel/air mixture within tool 10, as described below, and then activating the trigger. Nailer 10 will typically have a safety mechanism (not shown) to prevent nailer 10 from being fired unless barrel 30 is in firm contact with a surface S.

Nailer 10 shares the same main components as the impact tool described in U.S. Pat. No. 4,712,379, which is incorporated herein by reference. Nailer 10 comprises a cylinder 12 which slidably receives a piston 14. Piston 14 and cylinder 12 are typically round in section although other shapes could be used without departing from the invention. For example, U.S. Pat. No. 4,712,379 shows an impact tool having a rectangular pump housing which could be used with this invention. A piston ring 31 is typically provided on a circumferential groove around piston 14 to seal piston 14 in cylinder 12. Any suitable type of piston ring may be used. By way of example only, a TEFLON composite piston ring may be used.

A rigid driver or "impact rod" 15 projects forwardly from the piston. The piston can be driven forwardly along cylinder 12 by suitably igniting a charge of mixed fuel and air in a combustion chamber 40. When piston 14 is driven forwardly, the is forward end 15A of driver 15 drives fastener 9 from barrel 30 into surface S.

Nailer 10 has a fuel system (not shown) of any suitable design. By way of example only the fuel system may include a connecting rod (not shown) which opens a fuel inlet valve (not shown) to allow a full charge of gaseous fuel to pass from a plenum (not shown) into combustion chamber 40 when nailer 10 is pressed against a surface S. A suitable type of fuel system is described, for example, in U.S. Pat. No. 4,365,471. The fuel may be, for example, butane, propane, MAPP gas or similar fuels.

Combustion chamber 40 is most preferably divided into an ignition chamber 42 and a detonation chamber 44 by a detonation plate 46. Detonation plate 46 has holes around its periphery. When fuel/air mixture in ignition chamber 42 is ignited by an ignitor, such as spark plug 26 then the combustion causes flame jets to extend through holes 48 which are spaced around the periphery of detonation plate 46 thereby efficiently compressing and detonating the fuel/air mix Lure in detonation chamber 44. Some possible constructions for detonation plate 46 are disclosed in U.S. Pat. No. 4,365,471 which is incorporated herein by reference.

The combustion of fuel in ignition chamber 42 and the subsequent detonation of fuel in detonation chamber 44 drives piston 14 along cylinder 12 as described above. As this happens, driver, or "impact rod" 15 does work, such as driving a nail. One or more exhaust ports 22 in the wall 12A are exposed to the volume behind piston 14 when piston 14 nears the end of its travel in cylinder 12. Exhaust gases can exit through ports 22.

The manual recycler in nailer 10 comprises a pump housing 19 which is axially displaceable relative to main housing 23. Barrel 30 projects from the forward end of pump housing 19. Pump housing 19 is preferably round in section. The cross sectional shape of pump housing 19 is not critical to the invention. Other shapes could be used without departing from the invention. A sealing member 50 provides a sliding seal between pump housing 19 and main housing 23. Pump housing 19 is biased forwardly in main housing 23 to a st)p position by a main bias means, such as a spring 18.

The forward travel of pump housing 19 relative to main housing 23 is limited by suitable stops In the preferred embodiment the stops comprise stop members 28, which may be, for example, flanges or set screws. Stop members 28 project inwardly from main housing 23 into grooves 24 in the outer surface of pump housing 19. The forward travel of pump housing 19 is stopped by abutting engagement of stop members 28 with the rearmost ends 24A of grooves 24.

One or more one-way exhaust valves 27 are located to vent the exhaust gases from combustion chamber 40 which enter the volume 52 inside pump housing 19. Preferably, valves 27 are located on the forward end of pump housing 19 as shown in FIG. 1.

A return spring 11 is located inside cylinder 12. Return spring 11 is preferably a round compression spring surrounding driver 15. Return spring 11 may, for example, be a coil spring, as illustrated in the drawings. Return spring 11 biases piston 14 rearwardly, at least when piston 14 is located in forward portions of cylinder 12. Return spring 11 is guided by spring guide flanges 25 on the forward side of piston 14 so that it does not scuff the walls of cylinder 12 as piston 14 moves back and forth along cylinder 12. A resilient bumper 21 is located at the forward end of cylinder 12. Bumper 21 slows and stops piston 14 before it hits the forward end of cylinder 12.

In the embodiment of the invent ion illustrated in FIGS. 1 through 5B, cylinder 12 has a constriction 16. The inner diameter of cylinder 12 is reduced at constriction 16. Constriction 16 provides some resistance to, but does not prevent, the passage of piston 14. One or more small venting ports 17 extend through the wall of cylinder 12 and communicate with volume 52 rearwardly from constriction 16. Venting ports 17 preferably comprise a number of small apertures spaced apart in a circumferential ring around cylinder 12.

Figure 5A:
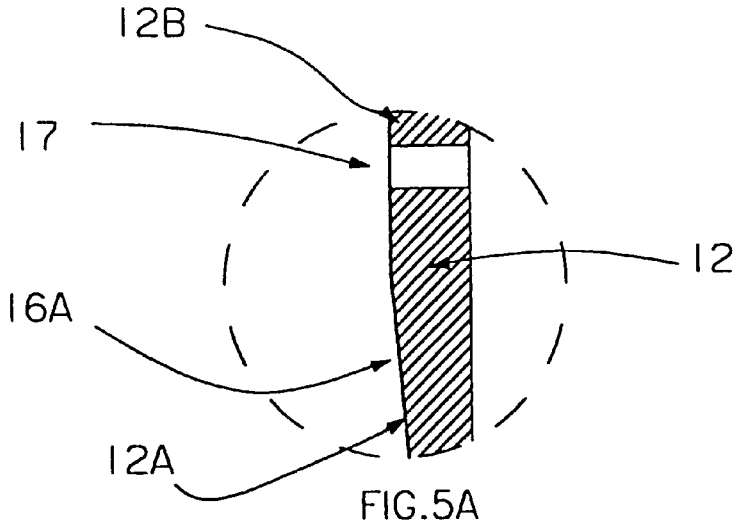
FIGS. 5A and 5B are detailed, exaggerated, sectional views of two alternative bore constrictions for use in the invention.
Figure 5B:
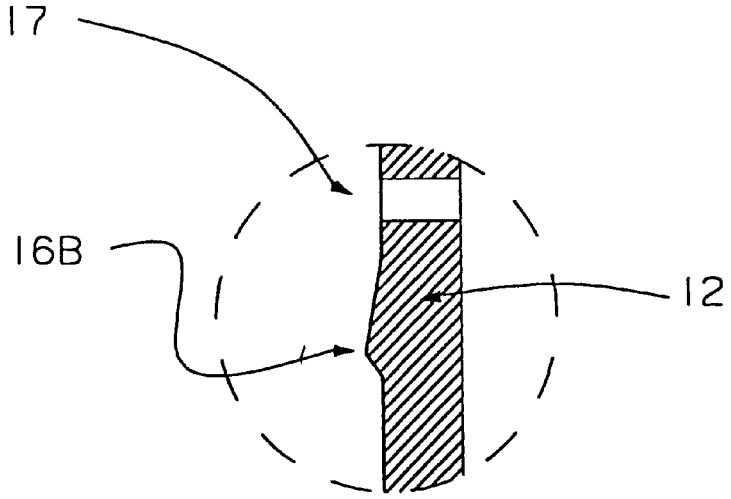
Figure 5C:
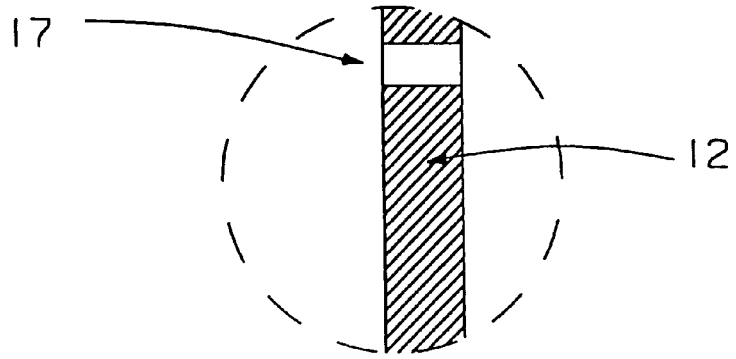
FIG. 5C is a detailed, exaggerated, sectional view through a nailer according to an alternative embodiment of the invention wherein a bore constriction is not required.

In the further alternative, as shown in FIG. 5C, the is benefits of the invention may also be obtained without the need for a constriction 16 as shown in FIG. 5C. An impact tool without a constriction 16 uses a short return spring 11. In this alternative embodiment of the invention, return spring 11 is short enough that, after nailer 10 is fired, return spring 11 pushes piston 14 back toward venting ports 17 and then extends to a length at which it applies no significant forced to piston 14 before piston 14 reaches its rest position in front of venting ports 17. Return spring 11 stores little enough energy that the friction between piston 14 and the straight wall of cylinder 12 is sufficient to stop piston 14 at a rest position slightly forward of venting ports 17 without the need of a constriction 16 to restrict the progress of piston 14 past its rest position. Return spring 11 may optionally disengage from piston 14 before piston 14 reaches its rest position.

Figure 2:
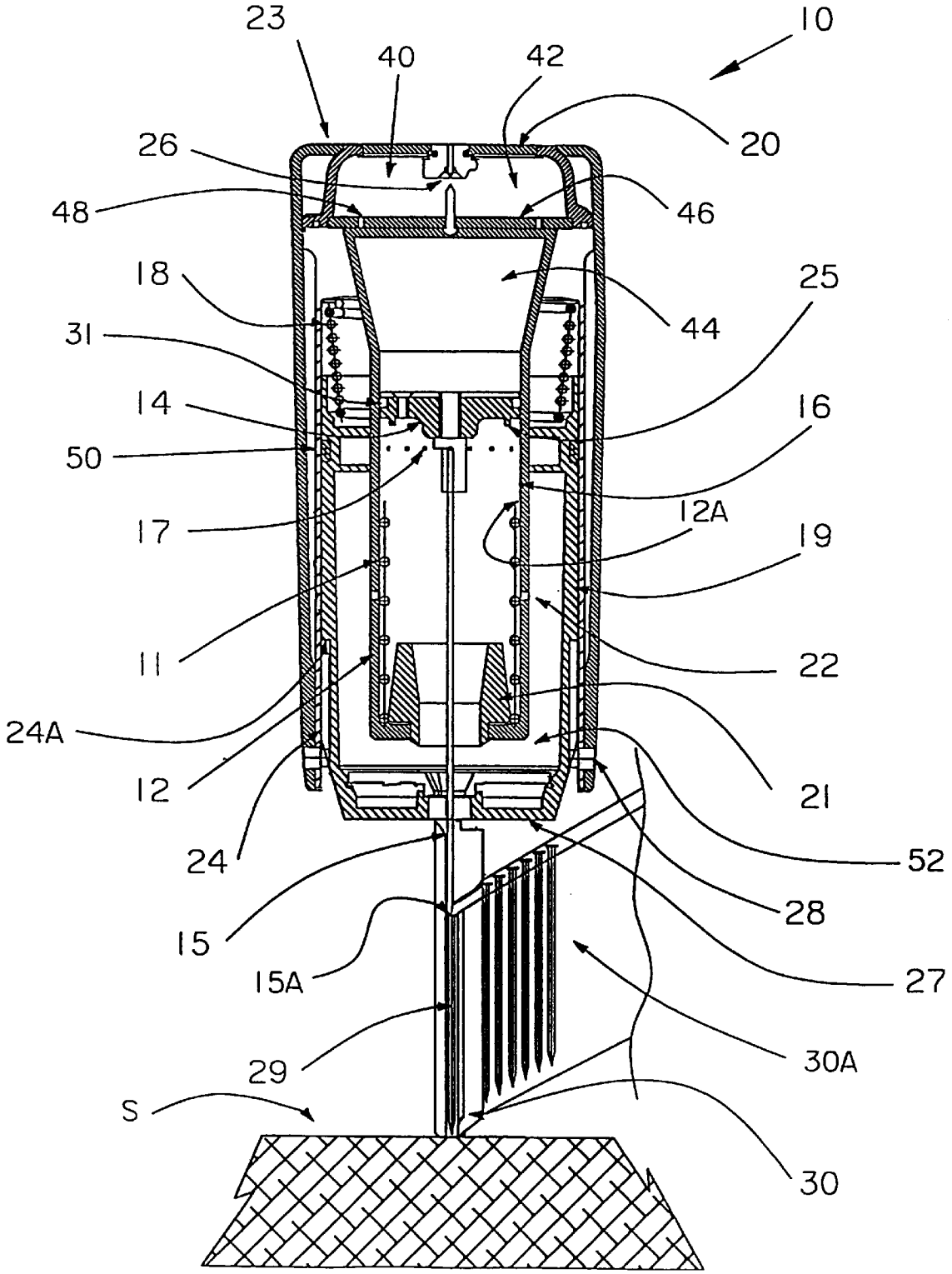
FIG. 2 is a sectional view of the nailer of FIG. 1 pressed against a surface in preparation for driving a fastener into the surface at the end of the compression stroke.

The operation of nailer 10 will now be described. With a fresh charge of fuel/air mixture in combustion chamber 40 a user presses barrel 30 of nailer 10 against a surface S, as shown in FIG. 2. The user keeps moving main housing 23 toward surface S until pump housing 19 is in its rearmost position in main housing 23 and piston 14 has been pushed past venting ports 17 toward combustion chamber 40 by fastener 29 acting on the end 15A of driver 15. At this point nailer 10 is ready to fire. The fuel/air mixture in combustion chamber 40 has been compressed by piston 14 and the safety mechanism (not shown), which should always be present, has been disengaged.

Next, the user fires nailer 10 by activating a suitable trigger device. The trigger causes a spark at spark plug 26. This, in turn, ignites the fuel/air mixture in ignition chamber 42 and detonates the fuel/air mixture in detonation chamber 44.

The detonation drives piston 14 along cylinder 12. The momentum of piston 14 and the pressure of the detonating fuel/air mixture behind piston 14 drives piston 14 past constriction 16. After piston 14 has passed constriction 16 then venting ports 17 are exposed to the combustion gases. Venting ports 17 are small enough that during the very short time frame of the combustion stroke the pressure driving piston 14 is not so reduced by leakage of high pressure combustion gases through venting ports 17 that the ability of nailer 10 to perform its intended function is impaired. Venting port, 17 comprise one or more suitably arranged apertures in the wall of cylinder 12. As piston 14 moves along cylinder 12 it compresses return spring 11.

Figure 3:
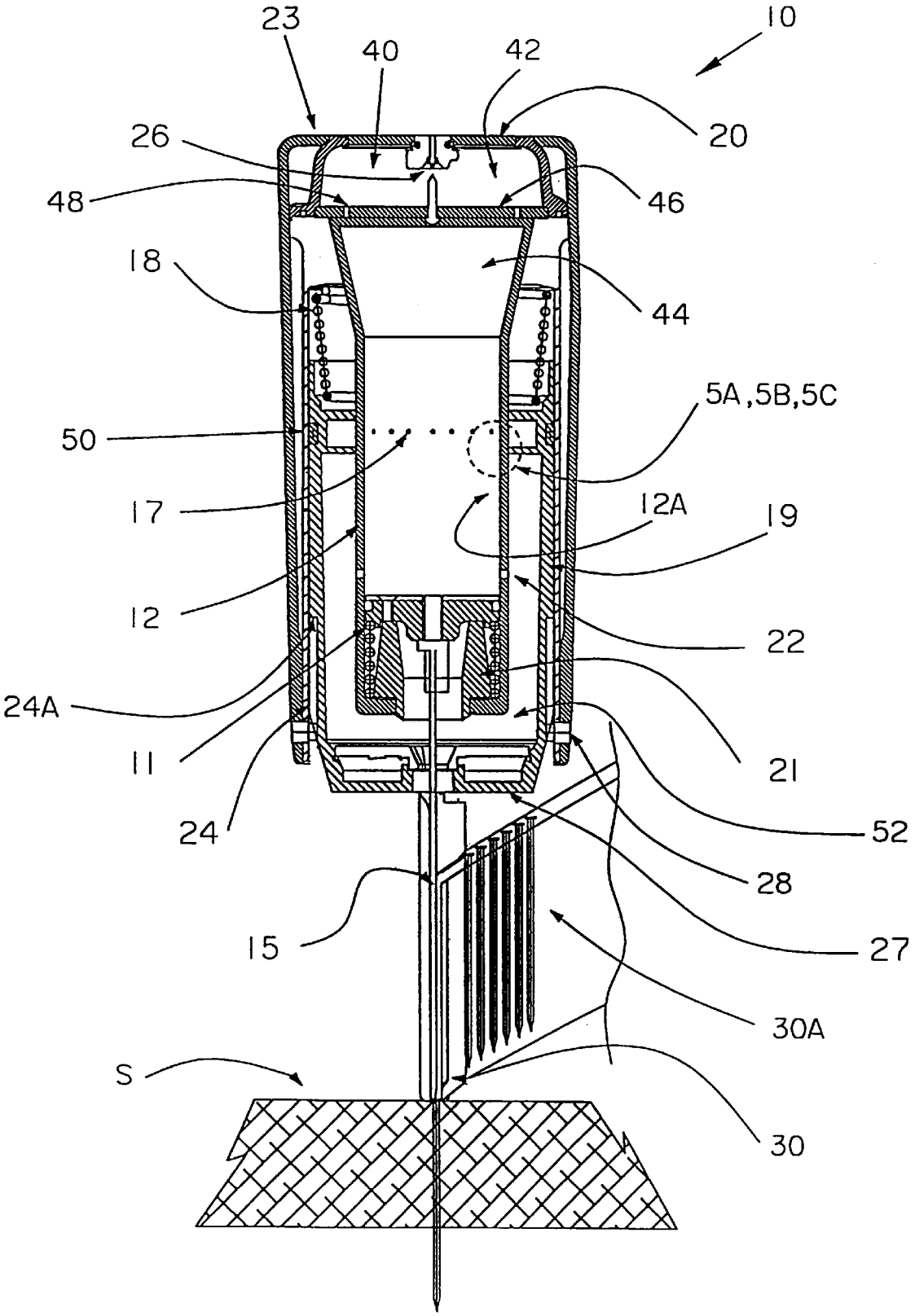
FIG. 3 is a view thereof at the end of the impact stroke with the fastener fully driven.

Piston 14 continues toward the end of cylinder 12 until it hits bumper 21 as shown in FIG. 3 Bumper 21 is generally longer than is provided in prior art impact tools. Bumper 21 absorbs the impact of piston 14. Bumper 21 stops the progress of piston 14 along cylinder 12 before spring 11 is compressed to a point that its spring characteristics would be significantly impaired over many cycles of us,e. If return spring 11 is a coil spring then there should be space between each coil of spring 11, as shown in FIG. 3, when piston 14 has been stopped by bumper 21 and spring 11 is maximally compressed.

When piston 14 reaches the end of its stroke then combustion gases can exhaust through exhaust ports 22 into volume 52. Exhaust ports 22 are larger than venting ports 17 and allow combustion gases to quickly exit cylinder 12. After firing nailer 10, pump housing 19 is at its most rearward position in main housing 23, as shown in FIG. 3. With pump housing 19 in this position, volume 52 is relatively small compared to the volume of combustion gases generated by firing nailer 10. Excess combustion gases leave volume 52 through one-way exhaust valves 27.

Figure 4:
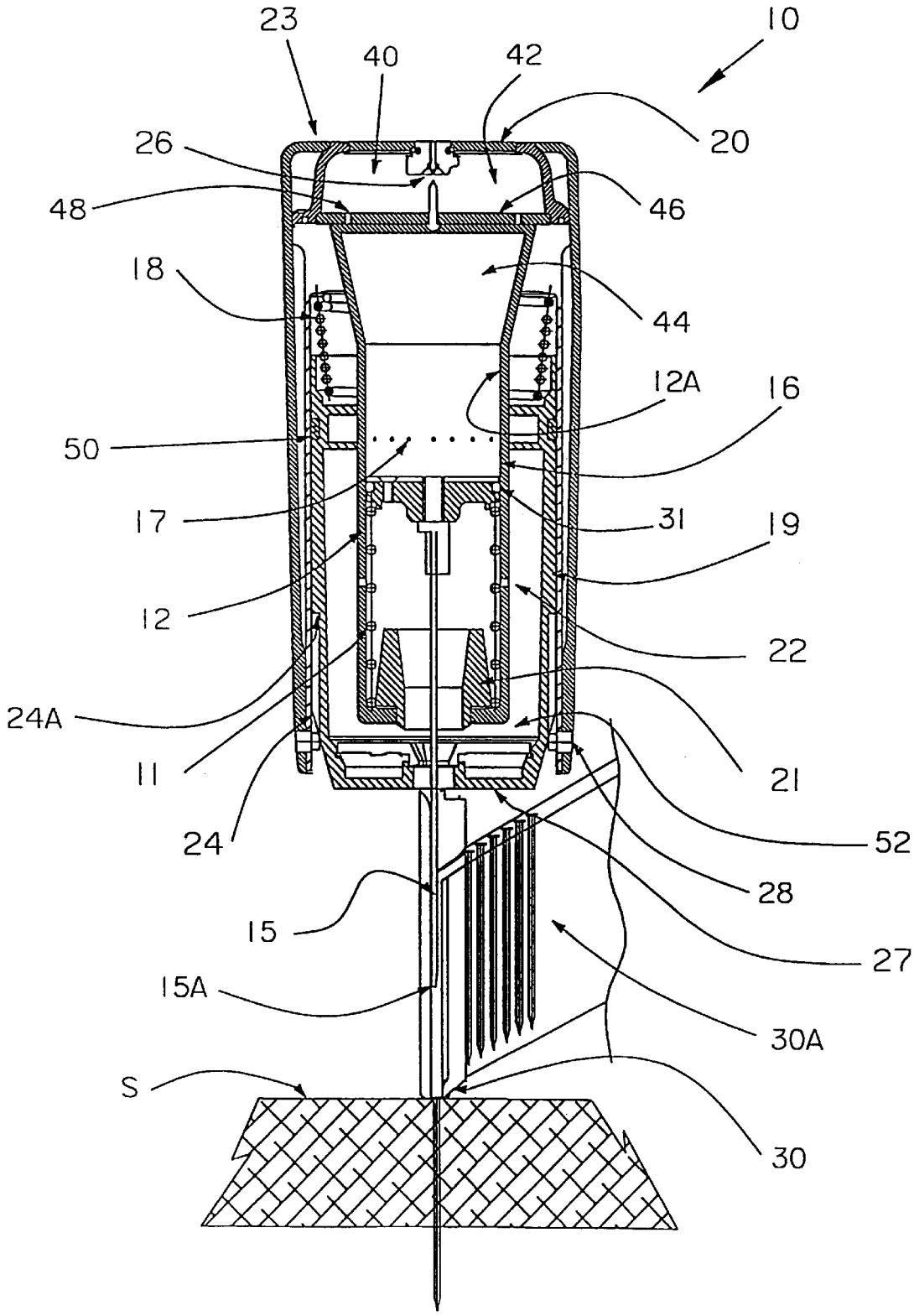
FIG. 4 is a view thereof shortly after the end of the impact stroke.

After piston 14 comes to rest then return spring 11 drives piston 14 and driver 15 back part of the way along cylinder 12 to a rest position as shown in FIG. 4. Venting ports 17 allow some of the remaining exhaust gases in cylinder 12 to vent from cylinder 12 as piston 14 moves toward its rest position. Venting ports 17 prevent gas pressure from building up behind piston 14 as piston 14 moves toward its rest position. This could interfere with the ability of spring 11 to drive piston 14 to its rest position.

In the embodiment of FIGS. 1 through 5B, piston 14 is stopped at its rest position, which is just forward of venting ports 17, by constriction 16. When piston 14 is in its rest position it does not obstruct venting ports 17. As shown in FIG. 5A, constriction 16 preferably comprises a junction 16A between a forward portion 12A of cylinder 12 in which the wall of cylinder 12 is gradually tapered and a rearward portion 12B of cylinder 12 in which the wall of cylinder 12 is straight. When piston 14 reaches the area of junction 16A then the interaction between piston ring 31 and the wall of cylinder 12 provides increased resistance to the motion of piston 14. In the further alternative, the entire bore of cylinder 12 could be tapered and the constriction 16 would then be the point at which the tapered bore of cylinder 12 squeezes piston ring 31 tightly enough to halt the further advance of piston 14 back along cylinder 12 after nailer 10 is fired.

In the alternative, as shown in FIG. 5B, constriction 16 may comprise a circumferential ridge 16B projecting inwardly into the bore of cylinder 12 just enough to provide sufficient resistance to the passage of piston 14 that re turn spring 11 is not strong enough to push piston 14 past ridge 16B. Ridge 16B is preferably a continuous circumferential ridge but may optionally comprise a number of inwardly projecting protrusions spaced apart around the circumference of cylinder 12.

Return spring 11 is chosen so that, when it is fully compressed, it stores enough potential energy to return piston 14 to its rest position but is not strong enough to push piston 14 past its rest position to a position where venting ports 17 are blocked.

When a user lifts barrel 30 away from surface S then pump housing 19 is no longer held compressed into main housing 23. Spring 18 is therefore able to push pump housing 19 forwardly toward its stop position as shown FIG. 1. As this happens, volume 52 expands. Because valves 27 are one way valves and volume 52 is sealed by seal 50, the expansion of volume 52 draws purging and cooling air into combustion chamber 40 through inlet valves 20 while remaining combustion exhaust gases are drawn into volume 52 through venting ports 17. From volume 52 the exhaust gases can eventually exit through exhaust valves 27.

The change in volume of volume 52 as pump housing 19 moves through the full range of its motion should be sufficiently great that substantially all remaining exhaust gases are purged from combustion chamber 40 as pump housing 19 moves forwardly to its stop position. In general, for a given size of impact tool, as the stroke of pump housing 19 is reduced the volume of gases pumped by the pump housing is reduced. This can be compensated for by increasing the area swept by the pump housing. One way to accomplish this goal is to increase the diameter of pump housing 19. Consequently, the pump housing of an impact tool according to this invention may be somewhat larger in diameter than the pump housing of an impact tool having the same capacity but made according to U.S. Pat. No. 4,712,379.

When pump housing 19 moves forwardly it carries barrel 30 and magazine 30A with it. Driver 15 is attached to piston 14 which is not moving. Therefore, as pump housing 19 moves forwardly, driver 15 slides rearwardly in barrel 30. When pump housing 19 reaches its stop position, driver 15 has slid far enough back in barrel 30 for magazine 30A to introduce another fastener 29 into barrel 30 in front of driver 15 as shown in FIG. 1. It can be appreciated that since piston 14 and driver 15 have been retracted by the action of return spring 11, pump housing 19 can move through a stroke which is significantly shorter than nails 29 and yet still provide enough clearance for a new fastener 29 to be introduced into barrel 30 in front of driver 15.

Prior art impact tools of the type described in the Adams et al., U.S. Pat. No. 4,712,379, do not have a return spring 11. In such prior art systems piston 14 simply comes to rest at the end of cylinder 12. In such tools the manual recycler pump housing must move through a stroke which is at least as long as the longest fasteners for which the tool is designed. This can be tiring for a user who must manually operate the pump housing.

Nailer 10 is prepared for installing another fastener 29 by pressing barrel 30 of nailer 10 against, a work surface S. The rearward end of fastener 29 pushes against end 15A of driver 15. As the user pushes barrel 30 against surface S pump housing 19 moves rearwardly in main housing 23 against the bias force of spring 18. Fastener 29 pushes driver 15 and piston 14 past constriction 16 and venting ports 17. After piston 14 has passed venting ports 17 the continued advance of piston 14 rearwardly along cylinder 12 builds up compression in combustion chamber 40. Either during or just before this step, fuel is introduced into combustion chamber 40. At this point, nailer 10 is again ready to fire. The higher than atmospheric pressure in combustion chamber 40 prior to combustion results in greater detonation pressures than would be available if the fuel/air mixture in combustion chamber 40 was not compressed prior to ignition.

It can be appreciated that nailer 10 differs from the impact tool described in Adams et al., U.S. Pat. No. 4,712,379, primarily by the presence of return spring 11, venting ports 17 and, in the embodiment of FIGS. 5A and 5B, constriction 16. The presence of these elements in the contents of the invention makes possible a shortened stroke for pump housing 19. This, in turn, significantly reduces operator fatigue and improves the market appeal of nailer 10. The reduction of the stroke of pump housing 19 also reduces the necessary strength and length of main spring 18. This makes it easier and faster for an operator to use nailer 10. These benefits are achieved with a minimum of structural changes and only one added moving part.

In the embodiments of the invention described above, the manual recycler of an impact tool, such as nailer 10, is operated by pressing a portion of the impact tool against a surface S. This force directly drives pump housing 19 rearwardly relative to main housing 23 thereby operating the manual recycler of nailer 10 as described above. In some cases the requirement to press an impact tool against a surface in preparation for firing the tool can make it undesirably difficult to use the tool. This is particularly the case if the tool is being used in a position which requires its operator to reach overhead or to a full arms length in another direction.

FIGS. 6A through 7C show nailers according to alternative embodiments of the invention. These nailers include squeeze levers or handles coupled to pump housing 19 by a linkage indicated generally by 63. Linkage 63 may be any suitable linkage. An operator can recycle either of these nailers by: a) pushing the barrel 30 of the nailer against a surface S as described above; b) squeezing the squeeze letter which moves the pump housing 19 rearwardly in main housing, 23 by means of linkage 63; or, c) both pushing barrel 30 against a surface and squeezing the squeeze lever. It is notable that it would not be practical to make other than a very small capacity manually recycled impact tool operated by a squeeze lever without a stroke reduction system as described above. Prior manual recyclers as shown, for example, in Adams et al., U.S. Pat. No. 4,712,379 have pump housings which must be moved through longer strokes. Providing a compact light weight linkage 63 capable of moving a pump housing through such a long, stroke in response to the squeezing of a handle or lever is not easily practical without the stroke reduction described above.

Figure 6A:
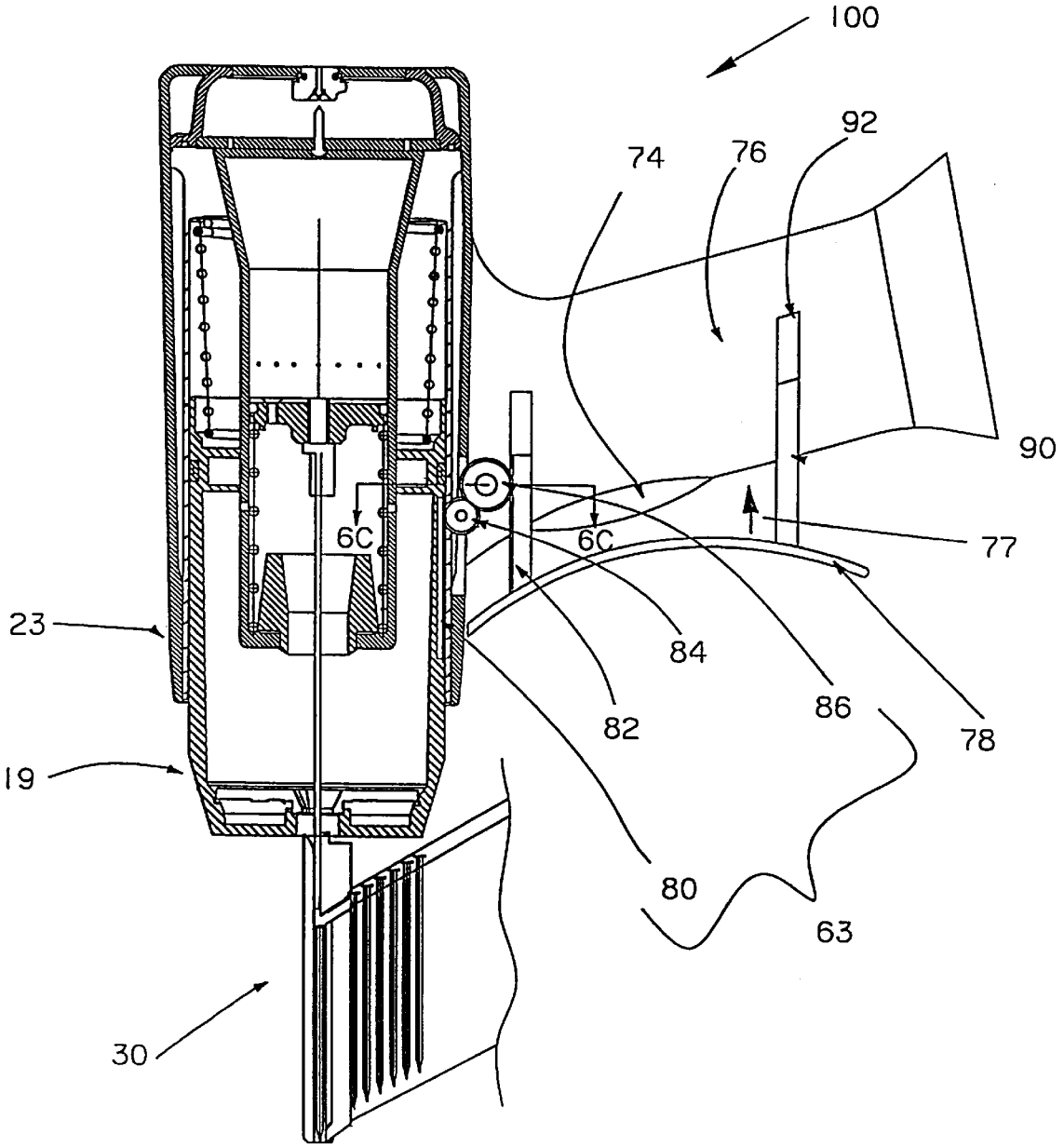
FIGS. 6A and 6B are side elevational views of a nailer having a manual recycler according to this invention and a squeeze lever for operating the manual recycler.
Figure 6B:
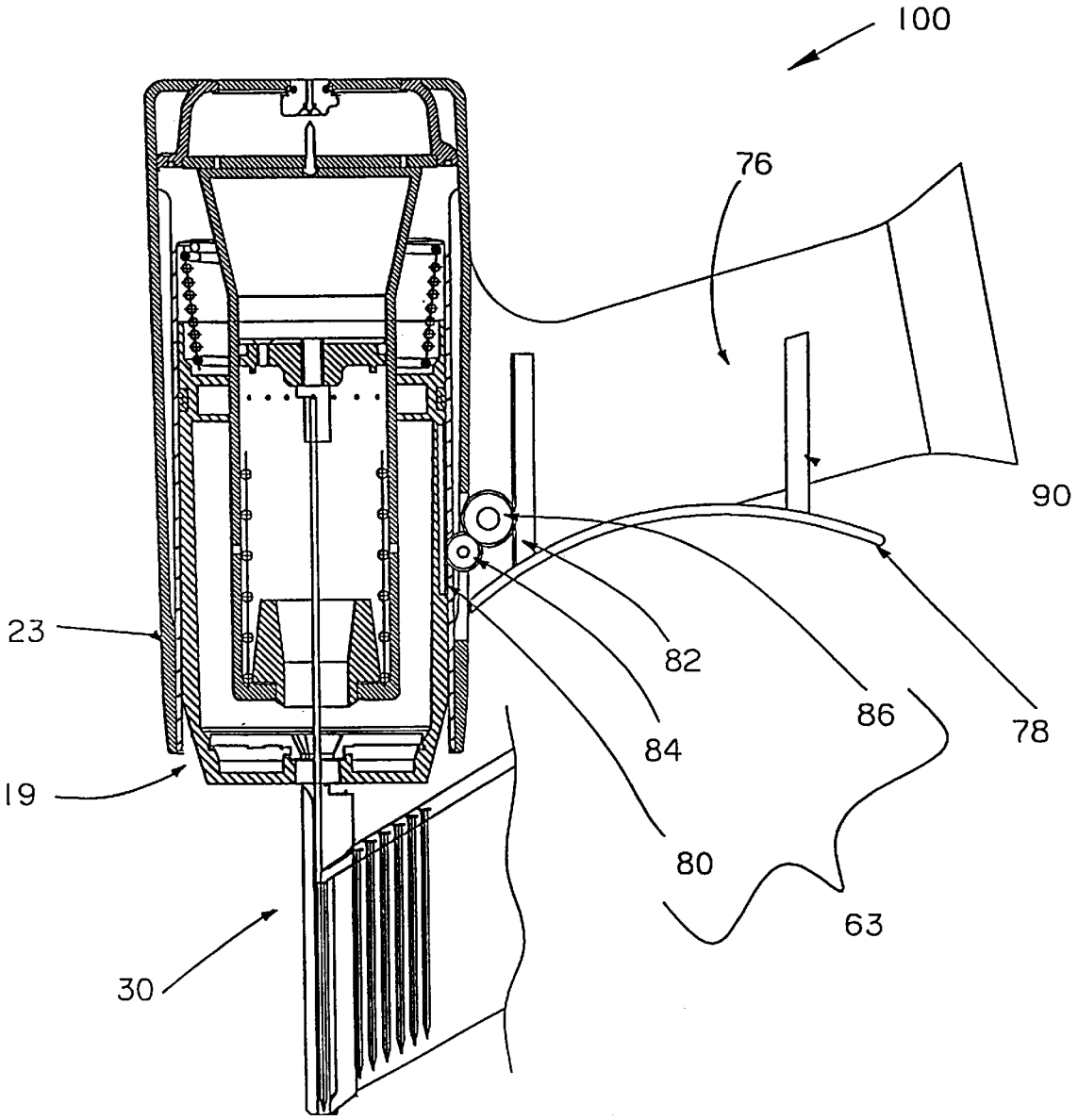

As shown in FIGS. 6A and 6B, a nailer 100 according to a first alternative embodiment of the invention has a handle 76 and a squeeze member, or squeeze handle 78 on handle 76. Squeeze handle 78 is coupled to pump housing 19 by a linkage 63 which comprises a rack 82, a gear train comprising a pair of gears 84 and 86 and a second rack 80 on pump housing 19. When a user grasps handle 76 and squeezes squeeze handle 78 toward handle 76 as indicated by arrow 77 then rack 82 turns gear 86 which, in turn, turns gear 84. Gear 84 engages rack 80 and draws rack 80 and pump housing 19 rearwardly into main housing 23 until pump housing 19 is fully refracted as shown in FIG. 6B. As pump housing 19 is drawn rearwardly piston 14 is driven rearwardly in cylinder 12 by the force exerted on the end 15A of driver 15 by a collated fastener 29. Alter this has been done, nailer 100 may be fired by pulling trigger 74 or, preferably, by placing nailer 100 against a work surface to release a safety device (not shown) and then pulling trigger 74.

Preferably linkage 63 causes pump housing 19 to move somewhat farther than the travel of squeeze lever 78. For example, in the embodiment of FIG. 6A, the ratio of the diameter of gear 86 to the diameter of gear 84 is preferably 1:1 or greater. This ratio may be called the transmission ratio of the gear train. Increasing this ratio tends to increase the amount of force that a user must apply to squeeze handle 78 to recycle nailer 100. Preferably the ratio is small enough that a user need not squeeze handle 78 with a force which would unduly tire a user's hand but the ratio is large enough that the motion of squeeze handle 78 is smaller than the corresponding motion of pump housing 19.

Figure 6C:
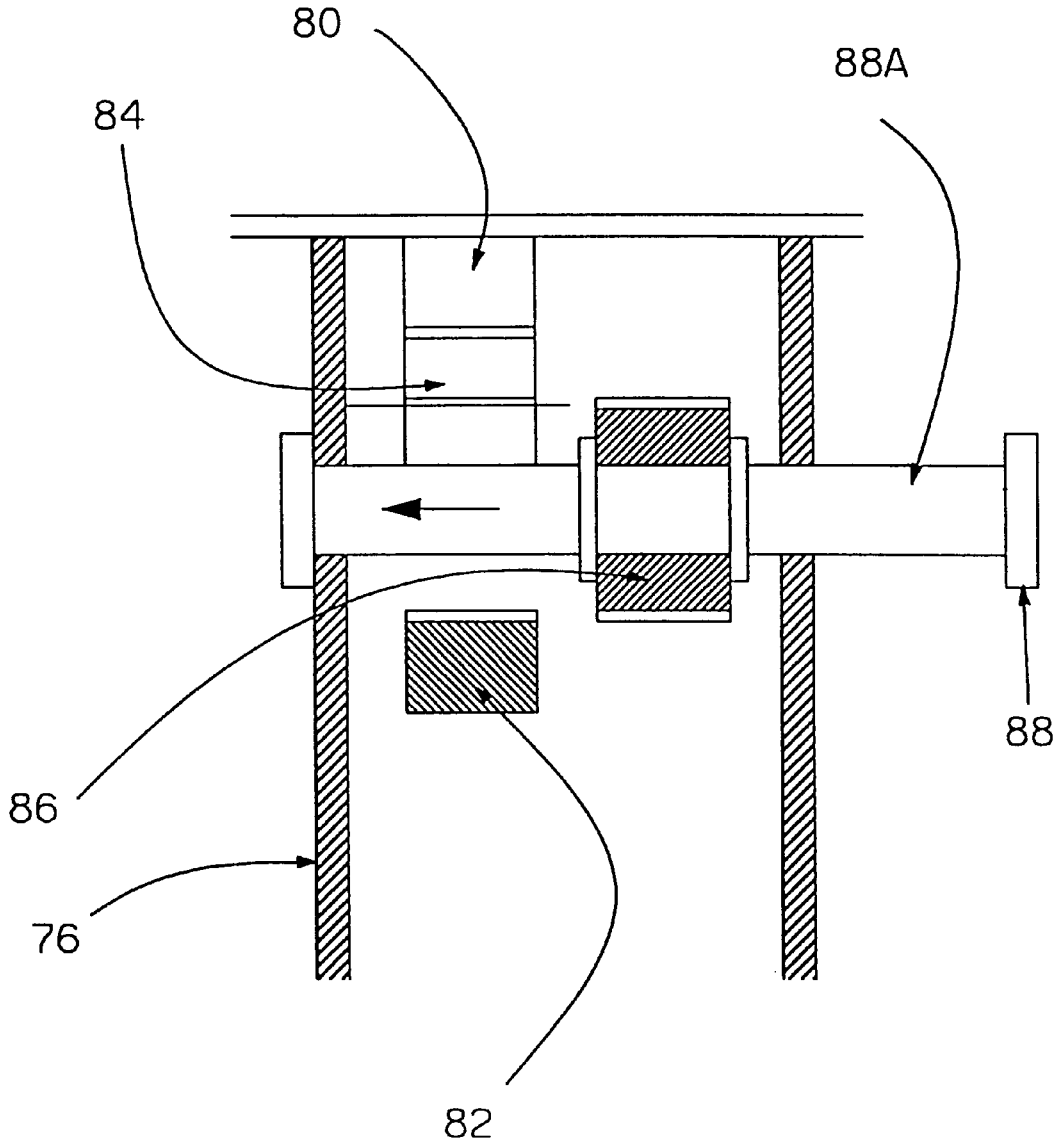
FIG. 6C is a sectional view in the plane 6C—6C showing a mechanism for disengaging a linkage for operating a manual recycler in response to motion of a squeeze lever; and, FIGS. 7A, 7B and 7C are side elevational views of a nailer having a manual recycler according to this invention and an alternative design of squeeze lever for operating the manual recycler.

Preferably linkage 63 includes disengagement means for uncoupling squeeze handle 78 from pump, housing 19. In the embodiment of FIGS. 6B and 6C, the disengagement means comprises a longitudinally slidable shaft 88A on which gear 86 is mounted. Shaft 88A can be slid from side to side in handle 76 by means of buttons 88 on its ends. A user can slide shaft 88A to one side so as to disengage gear 86 from rack 82 and/or gear 84 as shown in FIG. 6C. Squeeze lever 78 may then be moved into handle 76 to a position where it is out of the Ray. Nailer 100 can be recycled when linkage 63 is disengaged by pushing barrel 30 against a surface S as described above with reference to nailer 10.

Figure 7A:
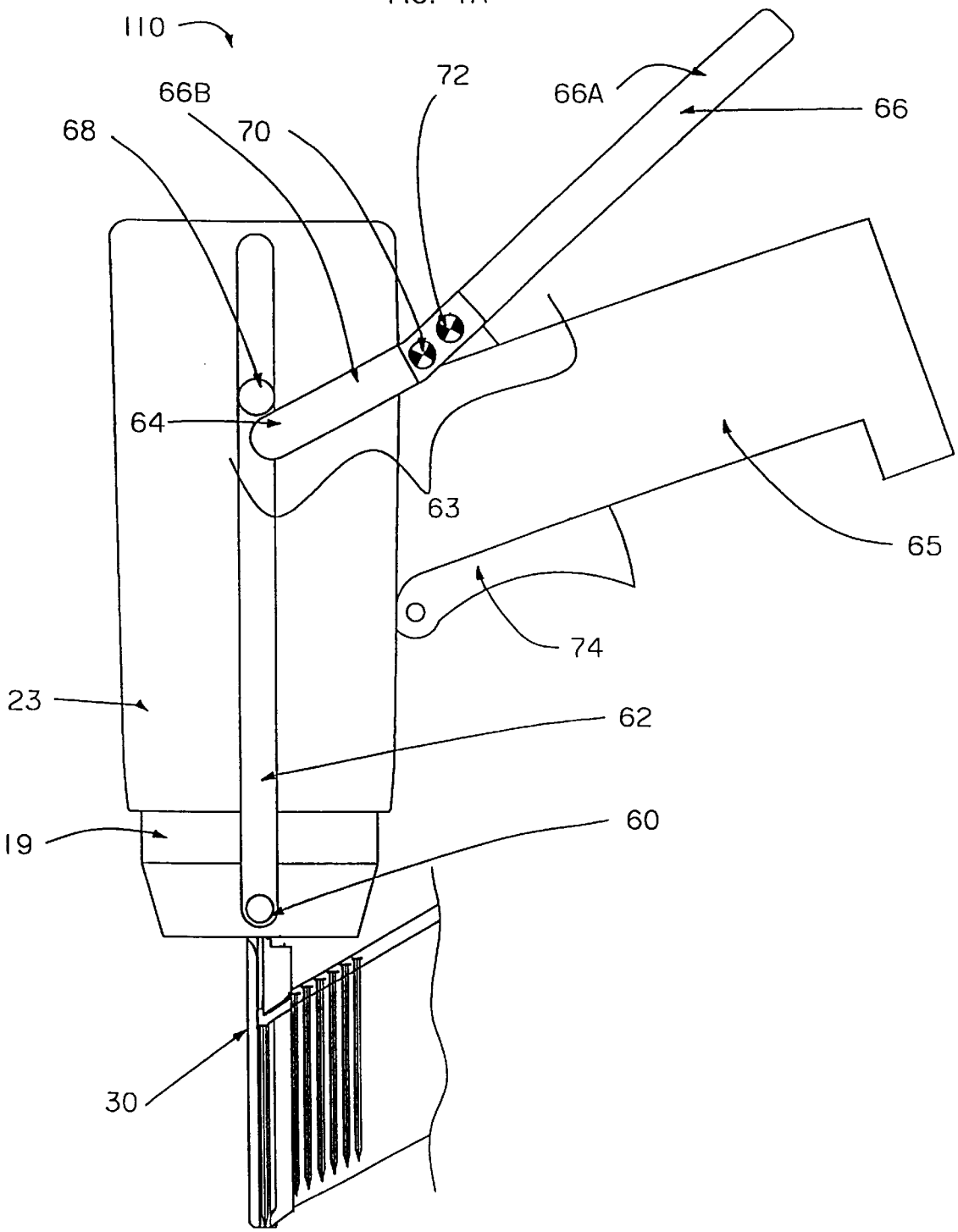
Figure 7B:
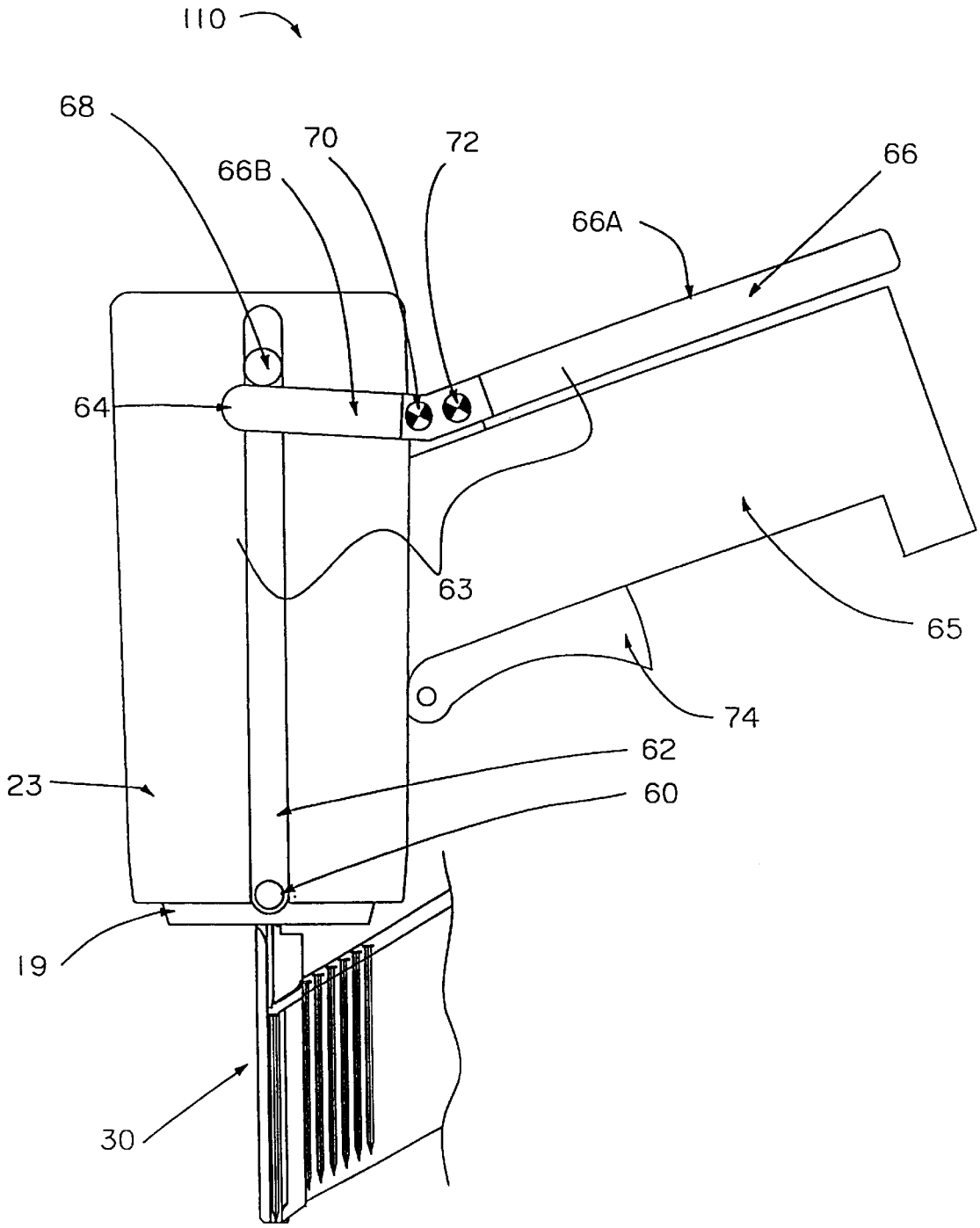
Figure 7C:
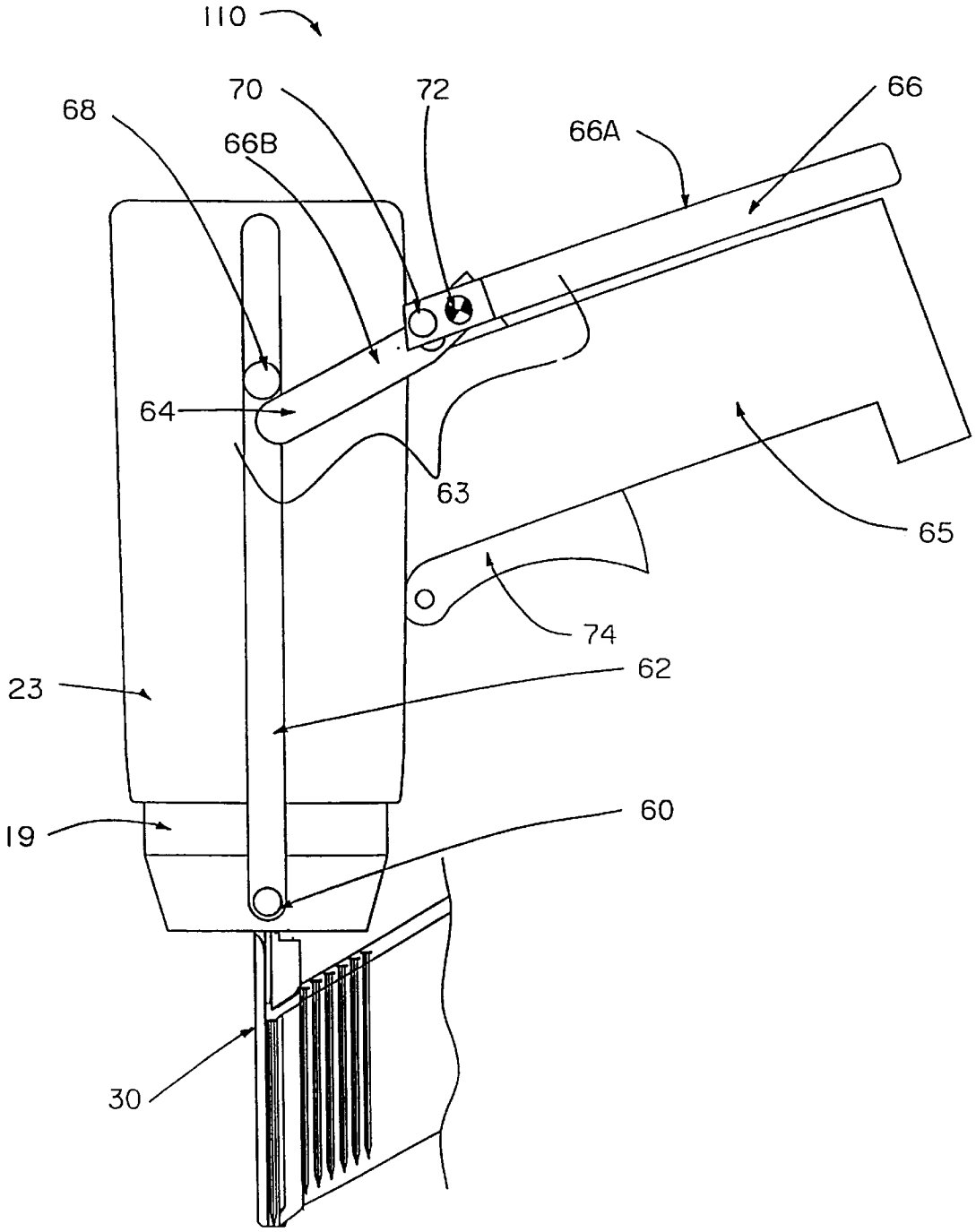

FIGS. 7A, 7B and 7C show a nailer 110 according to a further alternative embodiment of the invention. Nailer 110 has a handle 65 and a squeeze lever 66 on handle 65. A user can squeeze lever 66 to move pump housing 19 rearwardly in main housing 23 instead of, or in addition to, pressing barrel 30 against a surface. Squeeze lever 66 is connected to pump housing 19 with a linkage indicated generally by 63. A user can retract pump housing 19 by squeezing lever 66 either before or when nailer 110 is in a position in which it is desired to drive a nail. Nailer 110 can then be fired simply by pulling trigger 74. A safety device (not shown) would typically be included to disable trigger 74 so that the operator could not fire nailer 110 unless tool 110 is in contact with a work surface.

In the embodiment of FIGS. 7A, 7B and 7C linkage 63 comprises a draw bar 62 which is pulled by squeeze lever 66. As shown in FIG. 7A, squeeze lever 66 is pivotally attached to handle 65 at a pivot pin 72. A second end 64 of lever 66 moves rearwardly when a user squeezes a first section 66A of lever 66 against handle 65 thereby moving lever 66 from the first position, shown in FIG. 7A, to the second position shown in FIG. 7B. Second end 64 of lever 66 pulls a draw bar 62 rearwardly. Draw bar 62 has a forward end connected to pump housing 19 at point 60. In the illustrated embodiment, second end. 64 bears against a pin 68 projecting from draw bar 62.

Most preferably, linkage 63 is constructed to pull evenly on opposed sides of pump housing 19 so that pump housing 19 does not become skewed and bind in main housing 23. This may be accomplished, for example, by providing separate draw bars 62 on each side of main housing 23 and by making second end 64 of lever 66 in the form of a yoke having two arms, one on each side of main housing 23, each arm linked to one of draw bars 62.

Squeeze handle 66 can preferably be folded out of the way and linkage 63 disengaged so that a user can optionally use nailer 110 in the same manner as nailer 10 which is described above. As shown in FIG. 7C, lever 66 comprises two sections, a section 66A which can be grasped by a user's hand and a section 66B which bears ends 64. Sections 66A and 66B are normally rigidly fastened together at pivot point 72 so, that lever 66 can operate linkage 63. A user can make this coupling flexible and thereby disengage linkage 63 by, for example, removing a pin 70 so that section 66A can be folded out of the way against handle 65 as shown in FIG. 7C.

It can be appreciated that this invention can provide the advantages of a reduced stroke and a squeeze member, such as squeeze lever 66 or squeeze handle 78 for recycling with only a few more simple moving parts than are present in prior art manually recycled impact tools.

As will be apparent to those skilled in the art in the light of the foregoing disclosure, many other Alterations and modifications are possible in the practice of this invention without departing from the spirit or scope thereof. The following are by way of example only. When cylinder 12 includes a constriction 16, return spring 11 may be long enough to remain in contact with piston 14 at all times. In the alternative, return spring 11 could be shorter and could disengage from piston 14 at some point after piston 14 has been pushed back in cylinder 12 to its rest position. Piston 14 would then re-engage with return spring 11 during the first part of its downward impact stroke.

Return spring 11 has been described as a coil spring. Return spring 11 could be replaced with another suitable bias means capable of sending piston 14 back to its rest position forward of venting ports 17 after the impact tool is fired. For example, return spring 11 could comprise a gas spring in which a volume of gas is compressed when the impact tool is fired and the compressed gas returns piston 14 to its rest position.

While the venting ports 17 and exhaust ports 22 have each been illustrated as a number of small round holes, other configurations, such as appropriately located slots could be used instead without departing from the invention. Exhaust valves 27 and/or intake valves 20 could be moved to other locations on an impact tool without departing from the invention.

The design of pump housing 19, main housing 23 and the seal around volume 52 may all be varied without departing from the invention. Spring 18 may be replace with any other suitable bias means capable of pushing pump housing 19 forwardly to its stop position relative to main housing 23. The forward motion of pump housing 19 relative to main housing 23 may be limited in any practical way.

The design of the linkage 63 which couples a squeeze handle or lever to pump housing 19 may be varied. The means for disengaging linkage 63 may be varied as well. The squeeze member may be located in front of or behind a handle of the impact tool.

While it would not be preferred, it might be possible to obtain some of the benefits of the invention by eliminating exhaust ports 22. If this were done then all exhaust gases would need to be vented through venting ports 17. This might require a larger volume pump housing and/or other modifications to an impact tool.

Accordingly, the scope of the invention is to be construed in accordance with the substance defined by the following claims.

What is claimed is:

1. An impact tool comprising:

a) a main housing;

b) a piston disposed within a bore of a cylinder in the main housing, the cylinder having a wall, the piston slidably movable along the cylinder bore between a rearward position and a forward position, the piston having a forwardly extending impact rod;

c) a return spring, the return spring, biasing the piston rearwardly in the bore when the piston is in its forward position;

d) a venting port in the cylinder wail, the venting port located forwardly of the piston when the piston is in its rearward position and rearwardly of the piston when the piston is in a rest position between the forward and rearward positions;

e) a pump housing slidably and sealingly mounted to the main housing, the pump housing and the main housing defining between themselves a pumping volume which communicates with the venting port, the pump housing displaceable rearwardly relative to the main housing between a first position and a second position; and, g) an exhaust valve venting the pumping volume; wherein, when the piston is in its rearward position and a fuel/air mixture behind the piston is detonated, the piston is driven forwardly to its forward position and then the return spring moves the position rearwardly to the rest position where the piston stops.

2. The impact tool of claim 1 comprising an exhaust port forward of the venting port at a forward end of the cylinder wherein the piston is forward of the exhaust port when the piston is in its forward position.

3. The impact tool of claim 1 comprising a constriction in the wall of the cylinder, the constriction located forwardly of the venting port and rearwardly of the exhaust port.

4. An impact tool comprising:

a) a main housing;

b) a piston disposed within a bore of a cylinder in the main housing, the cylinder having a wall, the piston slidably movable along the cylinder bore between a rearward position and a forward position wherein the piston is forward from an exhaust port at a forward end of the cylinder, the piston having a forwardly extending impact rod;

c) a return spring, the return spring biasing the piston rearwardly in the bore when the piston is in its forward position;

d) a constriction in the cylinder bore between the rearward and forward positions;

e) a venting port in the cylinder wall rearwardly adjacent the constriction;

f) a pump housing slidably and sealingly mounted to the main housing, the pump housing and the main housing defining between themselves a pumping volume which communicates with the venting port, the pump housing displaceable rearwardly relative to the main housing between a first position and a second position; and, g) an exhaust valve venting the pumping volume;

wherein, when the piston is in its rearward position and a fuel/air mixture behind the piston is detonated, the piston is driven forwardly to its forward position and then the return spring moves the piston rearwardly until the constriction stops the piston at a rest position forward of the venting port.

5. The impact tool of claim 4 wherein the return spring is in the cylinder between the piston and a forward end of the cylinder.

6. The impact tool of claim 5 wherein the return spring is a coil spring and the impact rod passes through a bore of the return spring.

7. The impact tool of claim 4 comprising a resilient bumper at a forward end of the cylinder wherein the impact rod extends through a passage in the resilient bumper.

8. The impact tool of claim 7 wherein the resilient bumper blocks the piston from moving forwardly past its forward position.

9. The impact tool of claim 4 wherein the cylinder wall comprises a portion having a tapered diameter which decreases toward the rearward end of the cylinder and the constriction comprises a location along the cylinder wall where a fit of the piston in the cylinder provides increased resistance to rearward motion of the piston.

10. The impact tool of claim 4 wherein the constriction comprises a circumferential ring projecting inwardly from the cylinder wall.

11. The impact tool of claim 4 wherein the constriction comprises a plurality of projections spaced apart around an inner circumference of the cylinder wall.

12. The impact tool of claim 4 wherein the pump housing extends around the cylinder and the impact rod projects forwardly through a forward end of the pump housing.

13. The impact tool of claim 12 comprising bias means for biasing the pump housing forwardly in the main housing.

14. The impact tool of claim 13 wherein the bias means comprises a coil spring.

15. The impact tool of claim 14 comprising a barrel projecting forwardly from a forward end of the pump housing, the barrel having an axial aperture wherein, when the pump housing is in its second position and the piston is in its forward position, the impact rod projects through the barrel aperture.

16. The impact tool of claim 15 comprising a magazine connected to the barrel, the magazine adapted to feed a fastener into the barrel aperture each time the impact rod is withdrawn from the barrel aperture.

17. The impact tool of claim 4 comprising a handle, a squeeze member on the handle and adapted to be gripped by a hand of a user and a linkage coupling the squeeze member and the pump housing wherein squeezing the squeeze member causes the linkage to move the pump Lousing rearwardly.

18. The impact tool of claim 17 wherein the linkage comprises a gear train and the gear train provides a transmission ratio of 1:1 or greater.

19. The impact tool of claim 17 wherein the linkage comprises a disengagement means for uncoupling the squeeze member and the pump housing.

20. The impact tool of claim 4 comprising a linkage connecting the pump housing and the main housing, the linkage comprising a squeeze lever located so as to be graspable by an operator of the impact tool, the squeeze lever displaceable between a first position, wherein the pump housing is in its first position, and a second position, wherein the pump housing is in its second position, the linkage moving the pump housing from its first position to its second position in response to motion of the squeeze lever from its first position to its second position.

21. The impact tool of claim 20 wherein the squeeze lever comprises a lever arm having first and second sections pivotally connected to one another and means for releasably rigidly connecting the first and second sections.

22. A detonation impact tool comprising:

a) a cylinder having a bore and a detonation chamber portion in the bore;

b) an axially movable piston in the cylinder, the piston having a forwardly extending impact rod, the piston movable between a first rearward position and a second forward position;

c) a main housing surrounding a space around the cylinder;

d) a pump housing axially movable in the space between the cylinder and the main housing;

e) bias means biasing the pump housing forwardly in the space;

f) a seal between the main housing and the pump housing;

g) an exhaust passageway leading from a region of the cylinder cleared by a head of the piston at full impact stroke and through the pump housing;

h) a return spring between the piston and a forward end of the cylinder;

i) a brake providing resistance to rearward motion of the piston when the piston is moving in a region between the forward and rearward positions, the brake arresting return spring driven rearward motion of the piston at a rest position between the rearward and forward positions;

j) a vent passageway rearwardly adjacent the piston when the piston is in its rest position;

k) a check-valved inlet to the detonation chamber; and, l) a check valve in the exhaust passageway.

23. An impact tool comprising:

a) a main housing;

b) a piston disposed within a bore of a cylinder in the main housing, the cylinder having a wall, the piston slidably movable along the cylinder bore between a rearward position and a forward position, the piston having a forwardly extending impact rod;

c) bias means biasing the piston rearwardly in the bore when the piston is in its forward position;

d) venting means for allowing gases to escape from the cylinder, the venting means located forwardly of the piston when the piston is in its rearward position and rearwardly of the piston when the piston is in a rest position between the forward anti rearward positions; and, e) manually operable pumping means connected to the venting means for drawing gases out of the cylinder by way of the venting means;

wherein, when the piston is in its rearward position and a fuel/air mixture behind the piston is detonated, the piston is driven forwardly to its forward position and then the bias means moves the position rearwardly to the rest position where the piston stops.

24. The impact tool of claim 23 wherein the bias means comprises a coil spring in the cylinder.

25. The impact tool of claim 23 comprising braking means for arresting motion of the piston in the cylinder forward of the venting means.

26. The impact tool of claim 25 wherein than braking means comprises a constriction in the wall of the cylinder.

* * * * *